US007559161B2

(12) United States Patent
Stoetzer

(10) Patent No.: US 7,559,161 B2
(45) Date of Patent: Jul. 14, 2009

(54) SOIL WORKING METHOD AND APPARATUS

(75) Inventor: Erwin Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 222 days.

(21) Appl. No.: 11/189,722

(22) Filed: Jul. 27, 2005

(65) Prior Publication Data

US 2006/0032644 A1 Feb. 16, 2006

(30) Foreign Application Priority Data

Aug. 12, 2004 (EP) ..... 04019187

(51) Int. Cl.
*E20F 3/24* (2006.01)

(52) U.S. Cl. ..... 37/189; 37/91; 37/401; 175/91

(58) Field of Classification Search ..... 37/189, 37/365, 396, 401, 91, 462; 175/91, 96, 101, 175/104; 299/31, 75
See application file for complete search history.

(56) References Cited

U.S. PATENT DOCUMENTS

| | | | | | |
|---|---|---|---|---|---|
| 2,939,682 | A | * | 6/1960 | Kromberg | 173/26 |
| 3,443,648 | A | * | 5/1969 | Howard | 175/103 |
| 3,523,614 | A | * | 8/1970 | Walker | 212/289 |
| 3,700,045 | A | * | 10/1972 | Coontz | 173/26 |
| 4,051,456 | A | * | 9/1977 | Heilhecker et al. | 340/855.2 |
| 4,102,415 | A | * | 7/1978 | Cunningham | 175/96 |
| 4,202,416 | A | * | 5/1980 | Blaschke et al. | 175/94 |
| 4,314,615 | A | * | 2/1982 | Sodder et al. | 175/94 |
| 4,629,010 | A | * | 12/1986 | Sourice | 175/57 |
| 4,957,175 | A | * | 9/1990 | Lipsker et al. | 175/94 |
| 5,419,188 | A | * | 5/1995 | Rademaker et al. | 73/152.54 |
| 5,437,341 | A | * | 8/1995 | Horn et al. | 175/122 |
| 5,797,202 | A | * | 8/1998 | Akesaka | 37/189 |

FOREIGN PATENT DOCUMENTS

| | | | | |
|---|---|---|---|---|
| DE | 3905463 | A1 | | 8/1990 |
| DE | 4119212 | A1 | | 12/1992 |
| DE | 4141629 | A1 | | 6/1993 |
| JP | 06-128960 | | | 5/1994 |
| JP | 07-034771 | | | 2/1995 |
| JP | 7-34771 | A | | 2/1995 |
| JP | 07269466 | A | | 10/1995 |
| JP | 08-086183 | | | 4/1996 |
| JP | 10-195924 | | * | 7/1998 |
| JP | 10-195924 | A | | 7/1998 |

* cited by examiner

*Primary Examiner*—Thomas B Will
*Assistant Examiner*—Mai T Nguyen
(74) *Attorney, Agent, or Firm*—Jacobson Holman PLLC

(57) ABSTRACT

A soil working method, in which a soil working device suspended on at least one supporting cable is lowered by a supporting device and introduced into the ground. Subsequently, the soil working device is raised from the ground using the supporting cable and in addition to the supporting device a holding frame is provided and the supporting cable is connected to said holding frame. A soil working apparatus is also disclosed.

18 Claims, 7 Drawing Sheets

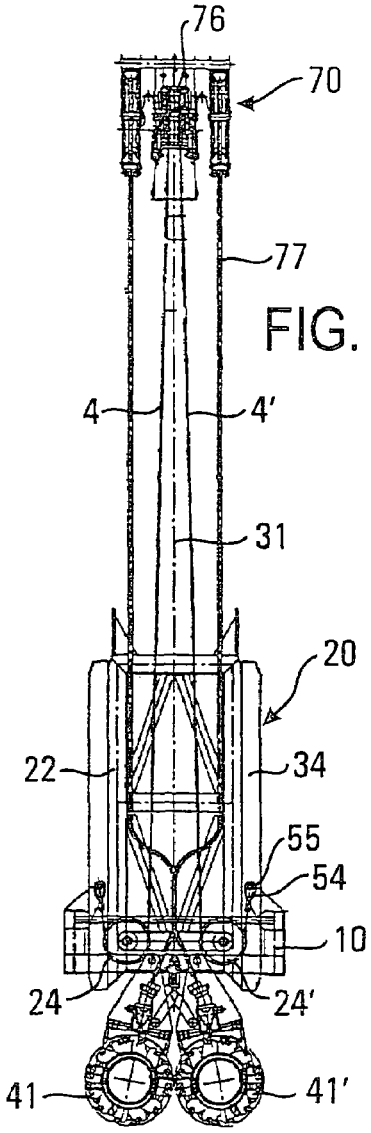
FIG. 1
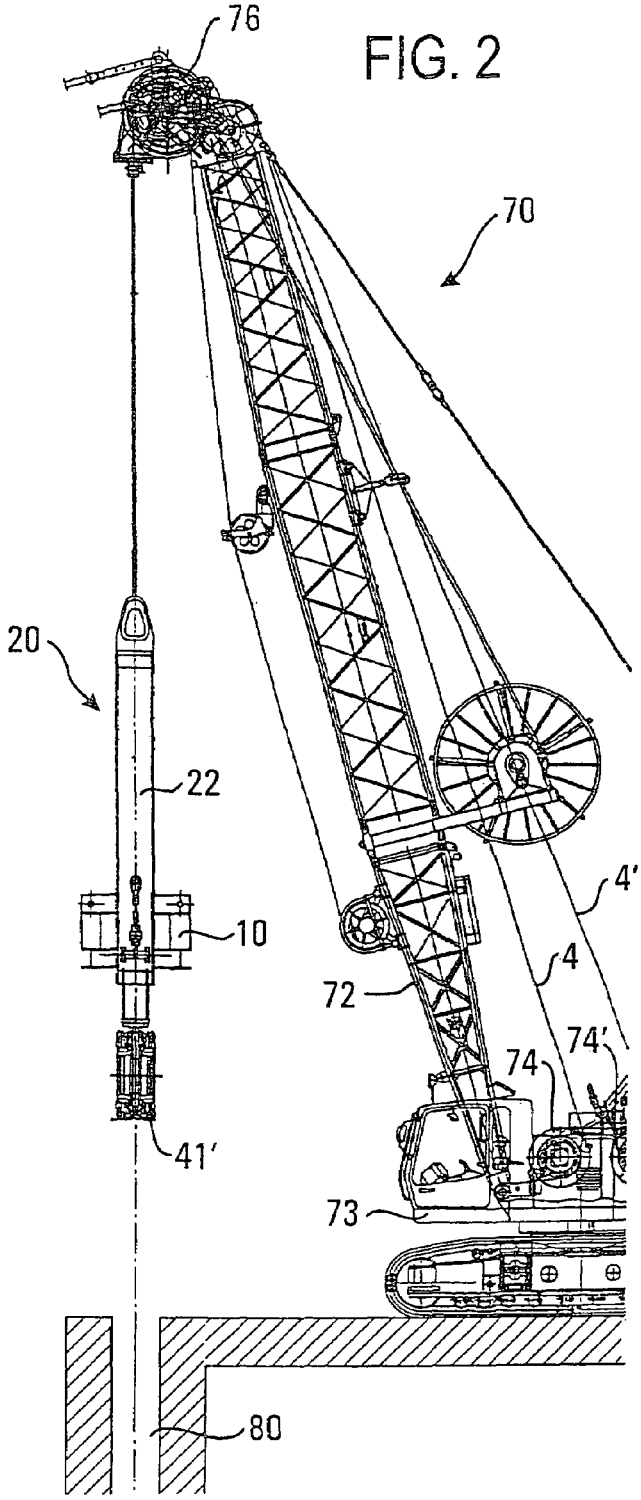
FIG. 2
FIG. 3
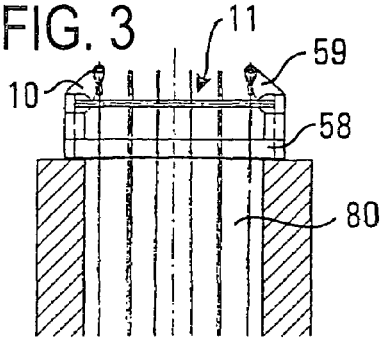

SOIL WORKING METHOD AND APPARATUS

BACKGROUND OF THE INVENTION

1. Field of the Invention

The invention relates to a soil working method, in which a soil working device suspended on at least one supporting cable is lowered from a supporting device and introduced into the ground and the soil working device is subsequently raised out of the ground by means of the supporting cable. The invention also relates to a soil working apparatus having a soil working device, particularly a cutter, which can be introduced into the soil by means of at least one supporting cable on a supporting device for soil removal purposes.

2. Related Art

A method and apparatus of the present type are e.g. known from DE 41 19 212 A1. The latter document describes a soil working device constructed as a trench wall cutter and which is suspended by means of a supporting cable on a truck jib. By means of said supporting cable the trench wall cutter is lowered into the ground, accompanied by the formation of a cut trench and is then raised from the trench produced.

Another trench wall cutting method is known from DE 41 41 629 C2. In this so-called single-phase method the cut trench is supported during sinking by a self-hardening suspension, which hardens to the trench wall after raising the cutter. If undesired delays occur in the single-phase method during trench sinking, there is a danger of a partial hardening of the suspension when the trench wall cutter is still in the trench. For raising the trench wall cutter it is then necessary to apply comparatively high tensile forces. The supporting device for the trench wall cutter must have a correspondingly complicated construction.

DE 39 05 463 A1 discloses another method for producing trench walls. According to this known method a trench wall cutter firstly cuts a trench. After reaching a desired final depth, the cutting width of the trench wall cutter is increased by moving apart its cutting wheels. The trench wall cutter is then raised, accompanied by the simultaneous cutting away of the trench side walls. Also in the case of this known method comparatively high forces have to be applied for raising the trench wall cutter. Consequently the supporting device supporting the trench wall cutter must have a comparatively complicated construction.

SUMMARY OF THE INVENTION

The object of the invention is to provide a soil working method and apparatus with a soil working device, which allow a comparatively simple, inexpensive construction of the supporting device of the soil working device.

This object is achieved by a soil working method in which a soil working device suspended on at least one supporting cable is lowered from a supporting device and introduced into the ground and the soil working device is then raised from the ground by means of the supporting cable, wherein in addition to the supporting device a holding frame is provided, the supporting cable is connected to the holding frame and on lowering and/or raising of the soil working device part of the cable tensile force is introduced via the holding frame into the ground; a soil working apparatus having a soil working device, particularly a cutter, which is introduceable into the ground for removing soil by means of at least one supporting cable on a supporting device, wherein in addition to the supporting device a holding frame is provided and that the supporting cable is connected to the holding frame, so that at least during the raising of the soil working device part of the tensile force is introduced into the soil via the holding frame.

The soil working method according to the invention is characterized in that in addition to the supporting device a holding frame is provided, that the supporting cable is connected to the supporting frame and that on lowering and/or raising the soil working device part of the cable tensile force is introduced into the ground via the holding frame.

It is a fundamental idea of the invention that the soil working device is not solely suspended on the supporting device and that in addition to the latter a holding frame is provided on which the soil working device is also suspended. As a result the tensile force of the soil working device is subdivided over the supporting device and the additional holding frame, which relieves the supporting device. Thus, the latter can be constructed in a particularly simple, inexpensive manner.

The soil working device can in principle be a random device which, for modifying the soil characteristics, is lowered into the ground, particularly into a ditch or trench therein, and is then raised again therefrom. For example, the soil working device can be a cutting device, a drilling device or a suspension interchange plate, which is introduced into a trench for interchanging different suspension types. The supporting device can e.g. be a crane or a construction truck.

According to the invention the soil working device is in tensile-proof connection both with the supporting device and the holding frame by means of the supporting cable. The supporting cable consequently runs on the soil working device at least twice along the trench to the soil surface. As opposed to the known direct suspension of the soil working device on the supporting cable, in this twin-lines reeving the supporting device is only loaded with half the tensile force, the remaining tensile force being supported on the ground via the holding frame. The tensile force can inter alia be formed by the weight of the soil working device and the feed forces of the soil working tools in the soil, particularly the circumferential forces of cutting wheels. The method of the invention is particularly suitable if a soil working is to take place during the raising of the soil working device, i.e. when the feed forces of the soil working tools have to be applied during raising. In this case the feed forces are added to the cutter weight force and are not applied by the weight force. Apart from a twin-lines reeving in the supporting cable, according to the invention there can also be a multi-lines reeving.

For the relief of the supporting device the holding frame is appropriately spaced from said supporting device, i.e. a connection between the holding frame and the soil working device exist solely via the supporting cable and optionally via control and supply lines. On the supporting device can also be provided a depositing device for depositing the holding frame on the ground surface. To the extent that the holding frame is connected to the supporting device, said connection is appropriately flexible, i.e. non-rigid, so that said connection does not transmit any tensile forces of the soil working device.

For a particularly effective force introduction by means of the holding frame into the soil, it is preferably placed directly on the soil or ground surface and there can optionally be an anchoring to the soil. The force introduction can be further improved in that the holding frame is placed on concreted, hardened base elements, particularly on hardened primary panels, i.e. primary lamellas of the trench wall. The holding frame which can also be referred to as a depositing, auxiliary and/or storing frame, is appropriately located in the vicinity of the upper edge of the ditch or trench and appropriately completely passes round the opening of the trench in the ground. The auxiliary frame can also be used for guiding the soil working device, particularly up to the time when it is introduced into the ground.

Fundamentally, the supporting cable can be connected in different ways to the holding frame. Thus, on the holding frame can e.g. be provided at least one return pulley used for guiding the supporting cable. In this case the supporting cable is connected to the holding frame in a displaceable, i.e. free manner. This is particularly advantageous if a three or multi-extrusion entrainment of the soil working device in the supporting cable is provided. Preferably the supporting cable can then be fixed terminally in tension-proof manner to the soil working device. However, it is particularly advantageous for the supporting cable to be terminally fixed in tension-proof manner to the holding frame. For this purpose can e.g. be provided on the supporting cable end a loop, which is hung in a pin on the holding frame. The supporting cable can alternatively or additionally be wound onto a cable drum provided on the holding frame. The terminal fixing of the cable to the holding frame can in particular be provided in conjunction with a twin-lines reeving of the soil working device, which requires particularly low construction costs.

According to the invention the supporting cable is appropriately guided freely on the soil working device, so that for lowering and raising the latter it is only necessary to have a single winch mechanism, particularly on the supporting device. The reducing supporting cable wear, it is particularly advantageous for the soil working device to be hung in the supporting cable by means of at least one return pulley located on said device. There can also be provided several return pulleys on the soil working device for a multi-line supporting cable guidance.

According to a particularly advantageous development of the inventive method, the holding frame is placed on the soil surface on lowering the soil working device and on raising the latter from the ground is carried along with and raised with said soil working device. Thus, according to this embodiment the holding frame is directly connected to the soil working device, if the latter is in the raised state outside the ground. The holding frame can then be displaced and positioned by the supporting device together with the soil working device, so that no additional supporting device is required for the holding frame. However, on lowering the soil working device, the holding frame thereon is placed on the ground surface and is left there on further sinking of the soil working device. During the subsequent raising of the soil working device from the ground, the holding frame is again carried along by said device and can then again be moved together therewith. For implementing this embodiment the soil working device appropriately has a driving device, which fixes the holding frame on the soil working device on drawing past the latter. As in this embodiment no independent supporting device is required for the holding frame, method costs can be further reduced.

It is particularly advantageous that a soil working cross-section of the soil working device in the ground can be modified, particularly prior to the raising of said device. To this end e.g. cutting wheels or other soil working tools can be moved on the soil working device. In this embodiment the soil is advantageously only worked, particularly worked off on raising the soil working device. As a result of the multiple suspension of the soil working device, both on the supporting device and on the holding frame, in the inventive method performance the tensile forces occurring in this embodiment can be particularly well absorbed. Through an appropriate choice of the soil working cross-sections, the soil working device can particularly initially be lowered without soil working into an already made ditch.

It is also advantageous to construct the soil working device as a cutter, particularly for cutting away the side walls of a trench in the ground. Over their entire width or only part of said width, the side walls can be cut away and in particular profiled. According to the invention this gives a particularly large variety of shapes to the trenches in the ground.

According to another preferred embodiment of the method, the soil working device is introduced into a secondary trench, which is adjacent to at least one hardened primary panel, particularly two hardened primary panels, and that the primary panel is cut partially, particularly profiled by the soil working device. According to this embodiment, in a first operation initially primary trenches are made in the soil and are filled with hardenable suspension and hardened, accompanied by the formation of primary panel, which can also be called trench wall lamellas. Secondary trenches are then made in the soil and are adjacent to the primary panels and are in particular located between two hardened primary panels. For forming a continuous trench wall, the secondary trenches can also be filled with hardenable suspension and hardened. As a result of the inventive partial cutting of the primary panels when making the secondary trenches, suspension cake, loam and/or other inhomogeneities present at the contact surfaces of the primary panels can be removed and consequently a particularly tight trench wall can be produced. Particularly during the production of the secondary trench cutting can take place into at least one and preferably both primary panels, so that the joint tightness between the primary panels and the secondary panels to be produced in the secondary trenches is increased. Since according to this preferred embodiment the joints between the primary panels and the secondary panels are worked, the method can also be referred to as a joint cutting method and the soil working device used for it as a joint cutter. The secondary trench into which the soil working device is introduced can be produced with the actual soil working device or by a further trench wall device.

It is a fundamental idea of the apparatus according to the invention that, in addition the supporting device, there is a holding frame, and that the supporting cable is connected to the holding frame, so that at least on raising the soil working device part of the tensile force is introduced into the soil via the holding frame. The inventive apparatus is particularly suitable for performing the inventive method, so as to achieve the advantages described in conjunction with said method.

It is fundamentally possible to fix the supporting cable end directly to the holding frame. For this purpose it is e.g. possible to provide on the cable end a ring, which is hung in a hook or a pin on the holding frame. In this case the length of the supporting cable relative to the holding frame is fixed and the free cable length is determined solely by a winch mechanism on the supporting device. However, it is more particularly preferred that the holding frame has at least one driven cable drum for winding up the supporting cable. In this case the free cable length can be modified by operating the holding frame cable drum. This embodiment is particularly advantageous if the soil working device is to be lowered to very great depths. On raising the soil working device the supporting cable can be received both by the cable drum on the holding frame and by the winch mechanism on the supporting device, so that use can be made of a winch mechanism with a comparatively limited reception capacity and which as such is comparatively inexpensive. Through the simultaneous operation of the cable drum on the holding frame and the winch mechanism, particularly high tensile forces can be produced.

If a cable drum is provided, the supporting cable is appropriately terminally fixed to said drum.

A particularly useful further development of the inventive apparatus involves a driving device for driving the holding frame on raising the soil working device from the ground being provided on said device. As a result the holding frame, as described in conjunction with the method, during the lowering of the soil working device is placed on the soil surface and on raising the soil working device from the ground is carried along and raised with said device. The driving device can e.g. have at least one protrusion, which corresponds to a corresponding protrusion on the holding frame.

According to the invention the holding frame has a passage opening for receiving and/or guiding the soil working device. Appropriately on raising the soil working device from the ground it passes through the passage opening and carries with it the holding frame during further raising. After placing the soil working device together with the holding frame on the ground surface, the passage opening can be used for guiding the soil working device during further sinking. Advantageously for this purpose the internal cross-section of the passage opening roughly corresponds to the external cross-section of the soil working device, particularly its cutting frame.

For the particularly simple cutting away of the side walls of a trench, particularly for cutting adjacent primary panels, it is advantageous for the soil working device to have at least two cutting wheels mounted in rotary manner, together with an adjusting device permitting the adjustment of the spacing of the rotation axes of the two cutting wheels. The rotation axes of the two cutting wheels are appropriately at least approximately oriented parallel to one another. The adjusting device can in particular have a toggle lever mechanism.

It is particularly advantageous for the soil working device and/or the holding frame to have a mirror symmetrical construction, particularly with respect to supporting cable guidance, a plane of symmetry preferably running approximately parallel to the rotation axes of the cutting wheels. Appropriately there are two supporting cables, both being guided in the same way on the soil working device and the holding frame. However, there may only be a single supporting cable, which is guided on its two cable ends on the soil working device and/or the holding frame and which in the cable centre is placed on the supporting device. The at least one supporting cable appropriately runs outside the plane of symmetry.

BRIEF DESCRIPTION OF THE DRAWINGS

The invention is described in greater detail hereinafter relative to preferred embodiments and the attached drawings, wherein schematically show:

FIG. 1 A front view of a soil working apparatus with a soil working device constructed as a cutter and with the latter raised in accordance with a first embodiment.

FIG. 2 A side view of the apparatus of FIG. 1.

FIG. 3 A holding frame of the apparatus of FIG. 1 with the cutter lowered, in front view.

Identically acting components are given the same reference numerals in all the drawings.

DETAILED DESCRIPTION OF THE PREFERRED EMBODIMENTS

Figure 4:
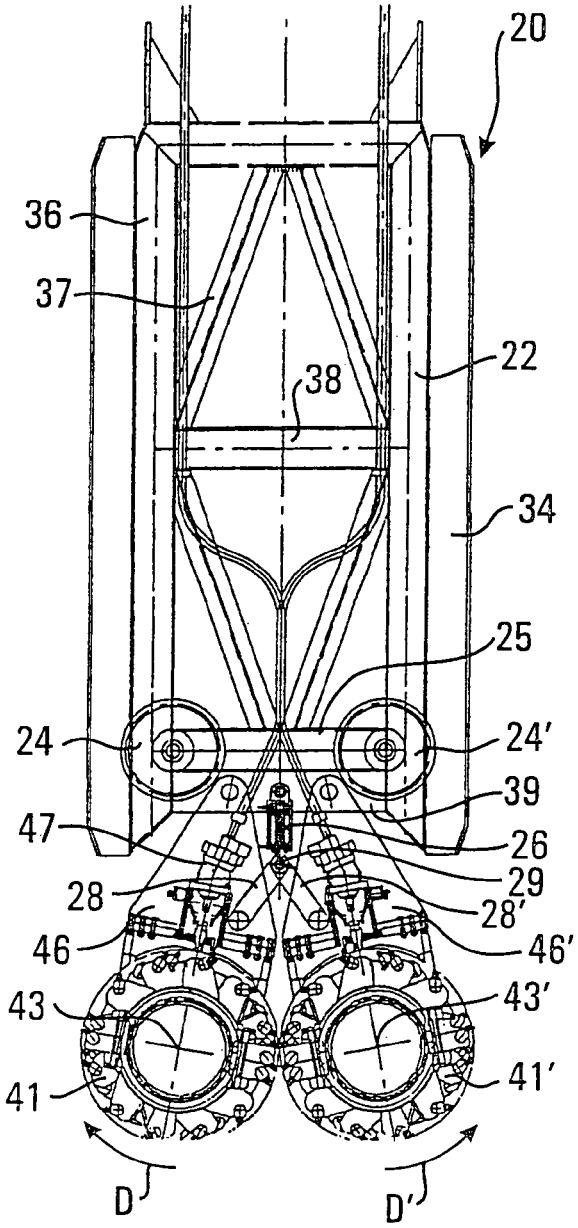
FIG. 4 A front view of the cutter of the apparatus of FIG. 1.
Figure 5:
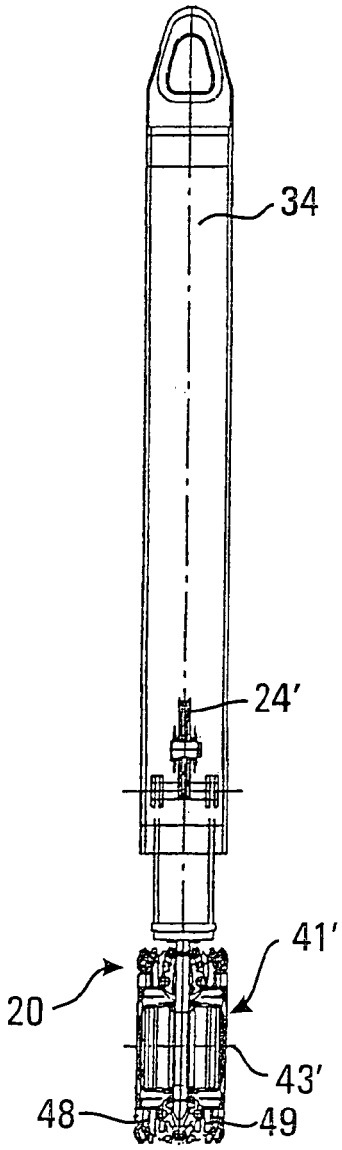
FIG. 5 A side view of the cutter of the apparatus of FIG. 1.
Figure 6:
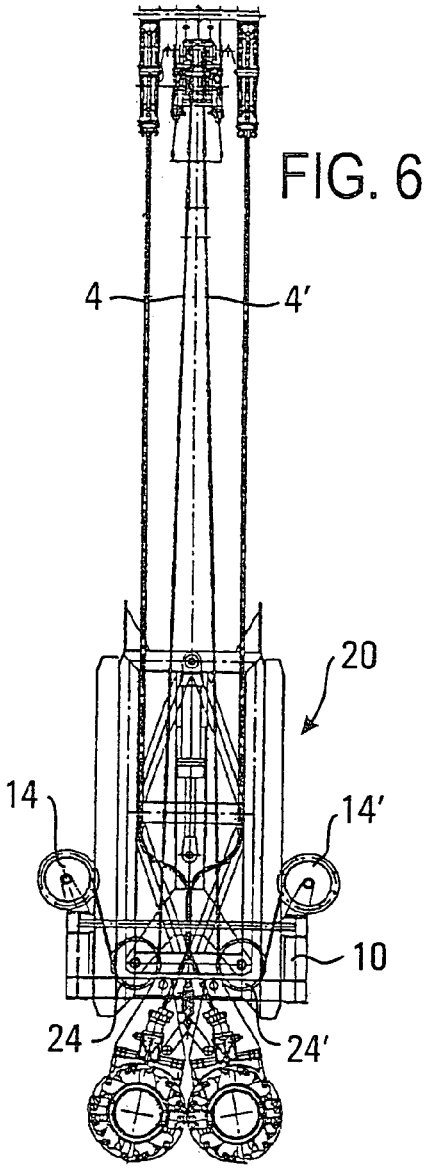
FIG. 6 A front view of a soil working apparatus with a soil working device constructed as a cutter and with the cutter raised, according to a second embodiment.
Figure 7:
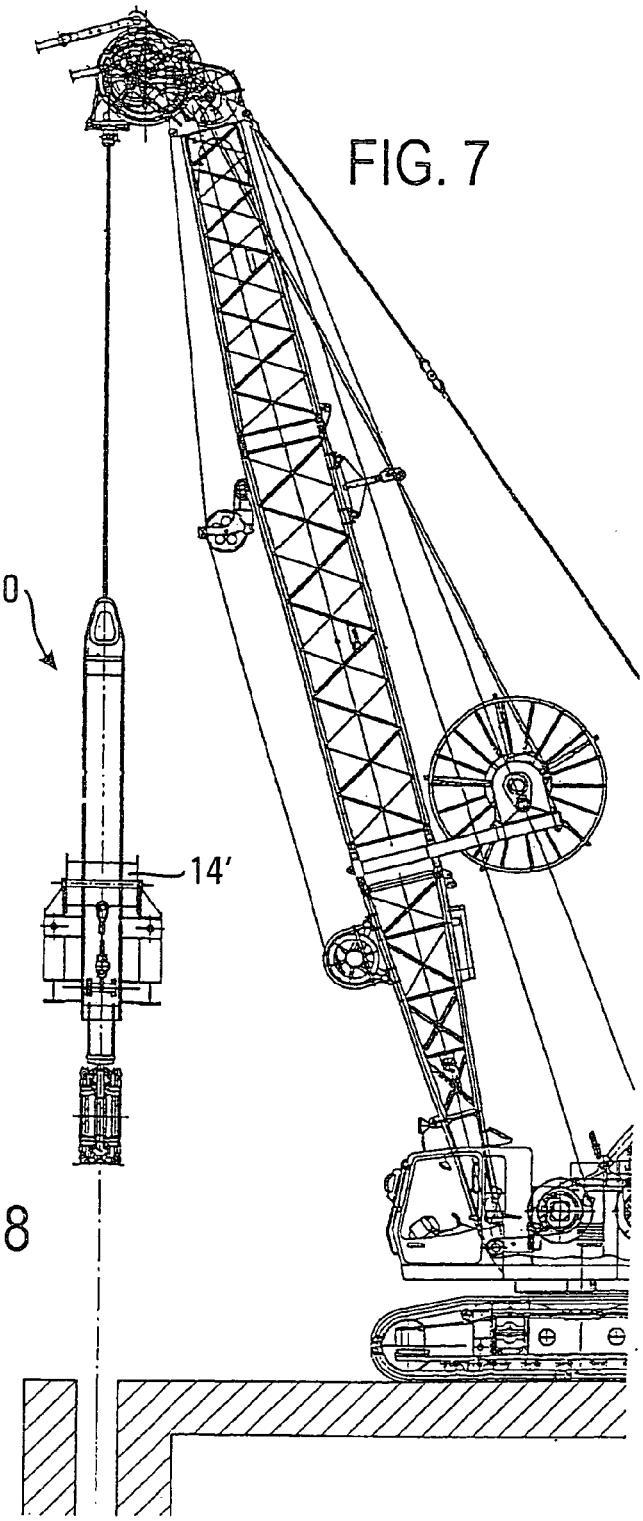
FIG. 7 A side view of the apparatus of FIG. 6.
Figure 8:
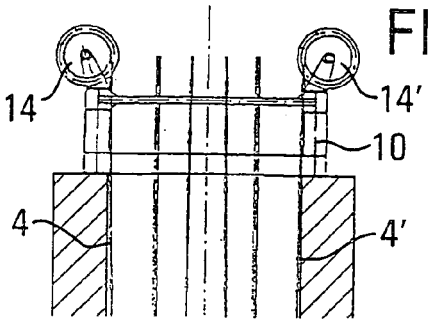
FIG. 8 A front view of a holding frame of the apparatus of FIG. 6, with the cutter lowered.
Figure 9:
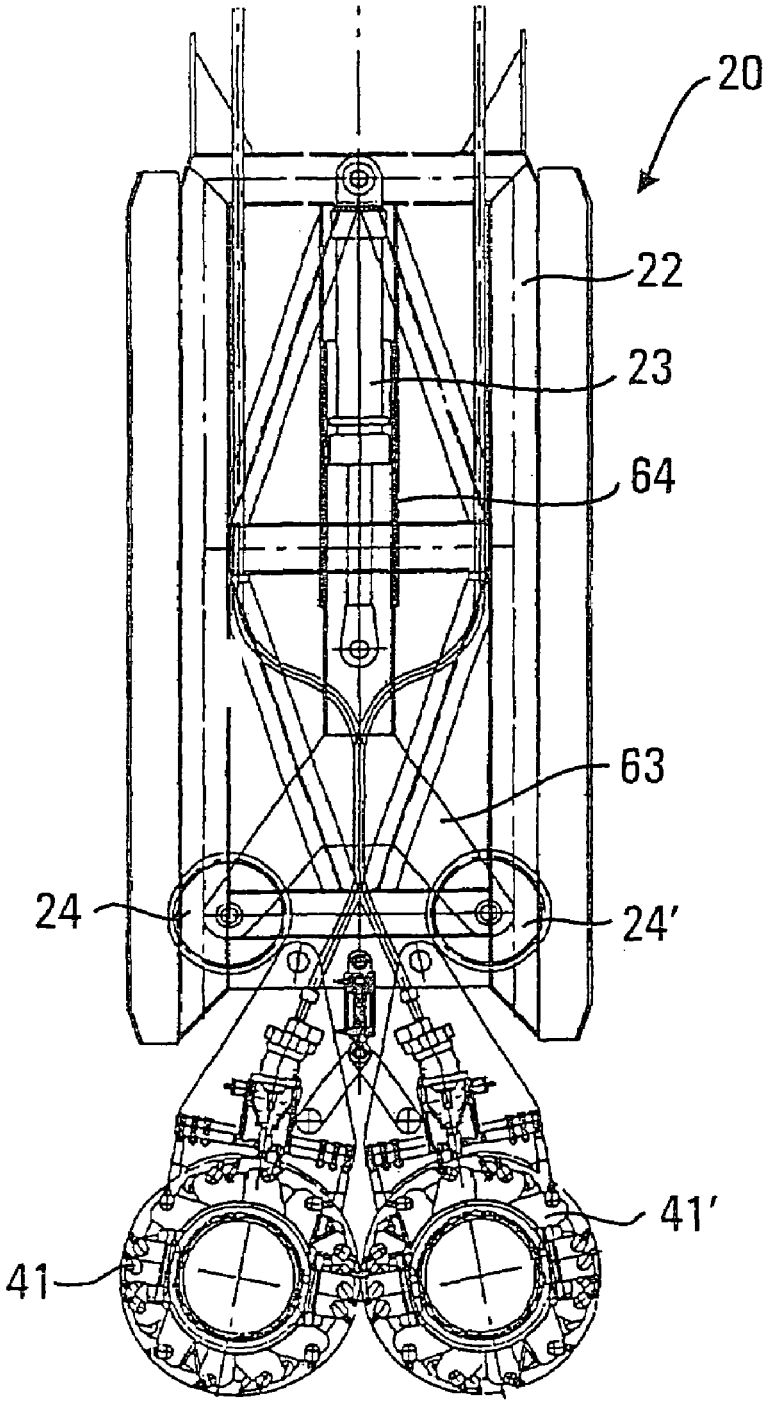
FIG. 9 A front view of the cutter of FIG. 6.
Figure 10:
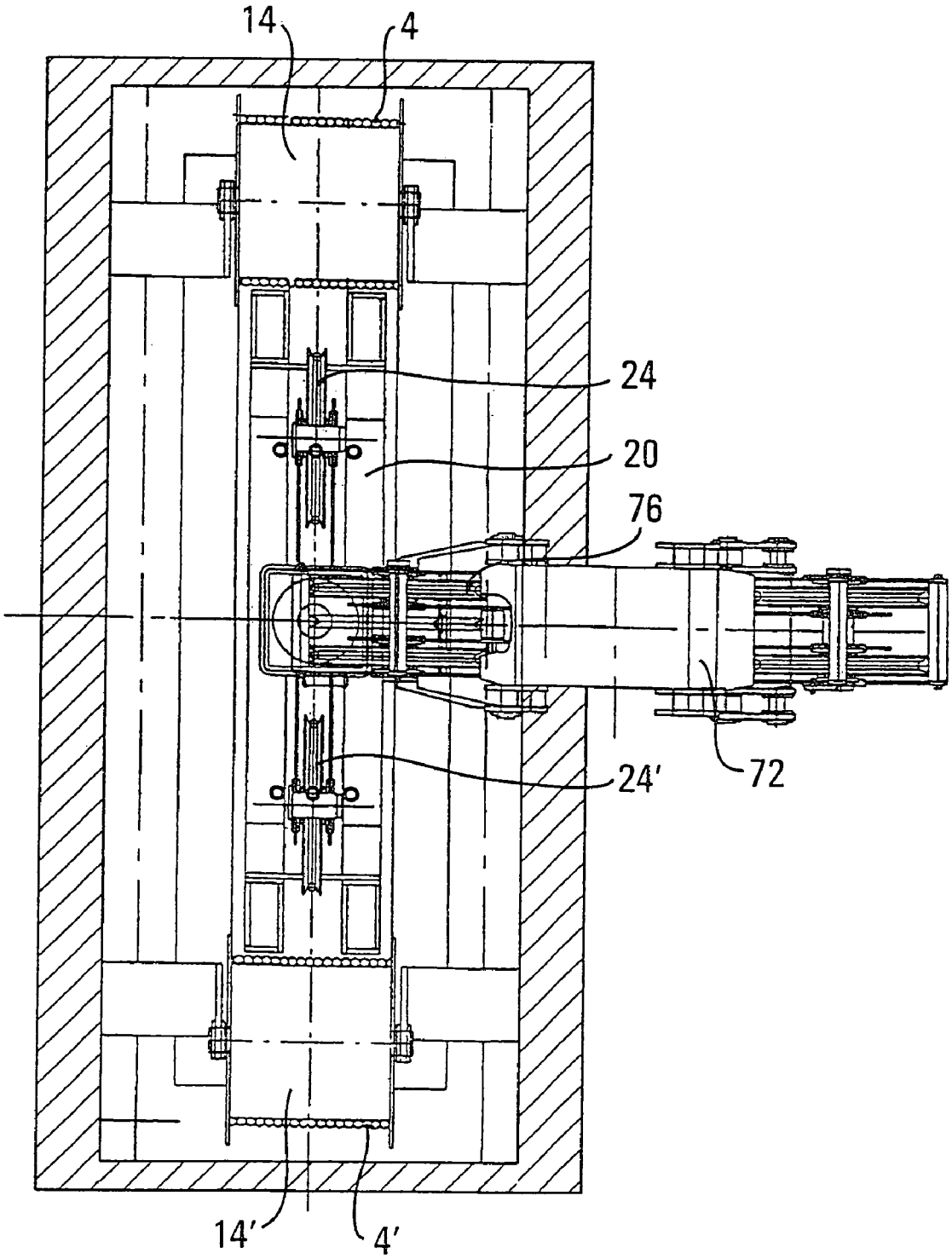
FIG. 10 A plan view of the apparatus of FIG. 6.
Figure 11:
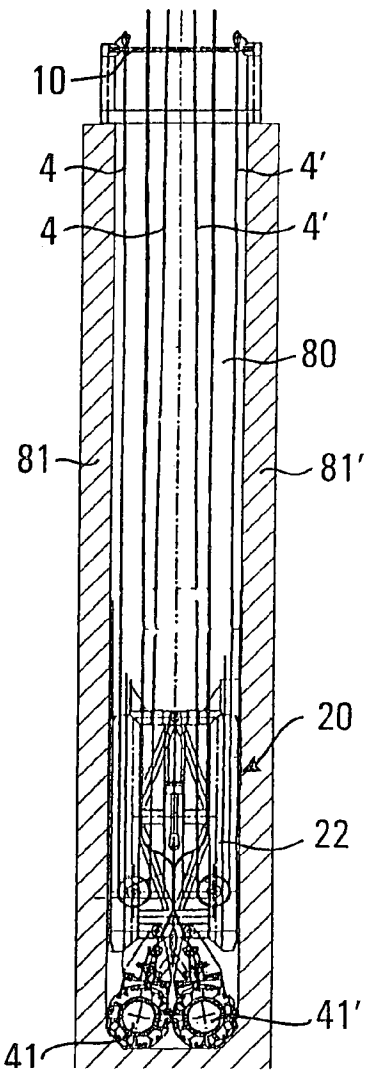
FIGS. 11 to 14 Different method stages in performing a soil working method.

A first embodiment of a soil working apparatus is illustrated by FIGS. 1 to 5. The apparatus has a supporting device 70 on which is suspended a soil working device in the form of a cutter 20 by means of two supporting cables 4 4'. The supporting device has a crane jib 72, which is pivotably located on a construction truck 73. For the operation of the supporting cables 4, 4' the supporting truck carries a winch mechanism with two cable winches 74, 74', the cable winch 74' being shown merely in broken line form. From the cable winches 74, 74' the supporting cables 4, 4' are guided along the crane jib 72 to the return pulleys 76 located on the top of the crane jib 72. The supporting cables 4, 4' are led round the return pulleys 76 and from there run along the crane jib 72 to the cutter 20. On the winch mechanism the supporting cables 4, 4' are connected to the supporting device 70.

The cutter 20 has a cutting frame 22 on which are mounted in a lower area and at the same height, as well as with parallel rotation axes two return pulleys 24, 24'. The supporting cables 4, 4' running virtually vertically downwards from the return pulleys 76 of the supporting device 70 are led around said return pulleys 24, 24'. Following onto the return pulleys 24, 24' of the cutting frame 22, the supporting cables 4, 4' return upwards again to a holding frame 10 to which they are terminally fixed. For this purpose the supporting cables 4, 4' are provided at the ends with loops 54, which are hung in bolts 55 in an upper area of the holding frame 10.

As can be gathered from FIGS. 1 and 2, the holding frame 10 is carried along and raised by the cutting frame 22 of cutter 20 when the latter is raised from the ground. For this purpose the cutter 20 has in the lower area of the cutting frame 22 a driving device with protrusions corresponding to protrusions on the holding frame 10. However, if the cutter 20 is lowered into a trench 80 in the ground, in the manner shown in FIG. 3 the holding frame 10 rests on the soil surface and remains on the ground in the vicinity of the upper edge of the trench 80 on sinking the cutter 20. As the supporting cables 4, 4' are fixed both to the supporting device 70 and to the holding frame 10, roughly half the tensile force of cutter 20 is absorbed by the holding frame 10, as soon as the holding frame 10 stands on the ground. As a result there is a reduction to the tension in supporting cables 4, 4' and the loading of the supporting device 70, particularly the cable winches 74, 74', on sinking and raising the cutter 20.

The holding frame 10 has a cage-like construction and is centrally provided with a passage opening 11 for receiving the cutting frame 22. Both the cutting frame 20 and passage opening 11 have a rectangular cross-section. The holding frame 10 has individual grid struts 58, which embrace the cutter 20 in the extracted state. In addition, on the top side of the holding frame 10 there are two projections 59 on which are located bolts 55 for fixing the supporting cable 4, 4'. To prevent friction on the walls of trench 80 by the supporting cables 4, 4' guided through the passage opening 11, the projections 59 with bolts 55 project into the cross-section of trench 80.

The cutting frame 22 has an inverted U-shaped outer frame 36, whose arms are supported via horizontally directed struts 38, 39 and sloping struts 37. On the bottom on the sloping struts 37, the cutting frame 22 has a horizontally directed support 25 on which are terminally mounted the two return pulleys 24, 24'. On the outside of the arms of outer frame 36 and on the front of the cutting frame 22 are provided flat guide elements 34, which run vertically along the cutting frame 22 and support the latter on the walls of the trench 80.

The cutter 20 has two cutting wheels 41, 41', which are mounted in rotary manner about parallel rotation axes 43, 43'. The cutting wheels 41, 41' are constructed as cutting wheel pairs and in each case have two individual cutting wheels 48, 49. The individual cutting wheels 48, 49 of the cutting wheel 41' are mounted on a bearing bracket 46' located between the individual cutting wheels 48, 49. Analogously the individual cutting wheels of cutting wheel 41 are located on a bearing bracket 46. For the rotary driving of the cutting wheels 41, 41', in each case one hydraulic drive 47 is provided on the bearing brackets 46, 46'. By means of said hydraulic drives 47, the cutting wheels 41, 41' are rotated preferably in opposite rotation directions D, D' and the left-hand cutting wheel 41 in front view is rotated clockwise and the right-hand cutting wheel 41' in front view counterclockwise. However, the reverse rotation direction is also possible.

The bearing brackets 46, 46' are pivotably mounted on the lower, horizontally directed strut 39 of cutting frame 22. The pivoting axes of the two bearing brackets 46, 46' are at least approximately parallel to one another. The pivoting axes are also at least approximately parallel to the rotation axes 43, 43' of cutting wheels 41, 41' and to the rotation axes of return pulleys 24, 24'. By means of an adjusting device the bearing brackets 46, 46' with the cutting wheels 41, 41' on cutter 20 can be pivoted, i.e. spread, so that the cutting cross-section of cutting wheels 41, 41' is variable. In particular, the cutting wheels 41, 41' can be spread in such a way that they project over the guide elements 34 of cutting frame 22 and consequently on raising the cutter work the walls of the trench 80 engaging on the guide elements 34.

The adjusting device has a toggle lever mechanism with two identically long levers 28, 28'. One end of the lever 28 is pivotably mounted on the bearing bracket 46, the pivoting axis of said bearing being at least approximately parallel to the pivoting axis of the bearing bracket 46 on cutting frame 22. In the same way one end of the lever 28' is mounted on the bearing bracket 46'. The in each case other end of the levers 28, 28' are interconnected in a joint 29. The axis of said joint 29 is at least approximately parallel to the pivoting axes of the bearing brackets 46, 46' on cutting frame 22.

The adjusting device also has a vertically directed hydraulic cylinder 26, which on its one side is mounted on the strut 39 of cutting frame 22 and on its other side on joint 29. If said hydraulic cylinder 26 is operated and extended, then joint 29 is moved downwards and the bearing brackets 46, 46' are spread or expanded by levers 28, 28'.

The cutter 20 and holding frame 10 are constructed in a substantially mirror symmetrical manner to a vertically directed plane of symmetry 31, running perpendicular to the drawing plane in FIG. 1. For supplying the hydraulic drives 47, hydraulic cylinder 26 and optionally further hydraulic operating means located on cutter 20, the apparatus for working the soil has supply lines 77 running from the top of the crane jib 72 to the cutter 20.

Another embodiment of a soil working apparatus is illustrated in FIGS. 6 to 10. The embodiment shown therein differs from the embodiment of FIGS. 1 to 5 in that the supporting cables 4, 4' are not fixed directly to the holding frame 10. On the contrary, the holding frame 10 of FIGS. 6 to 10 has on its top side a first cable drum 14 and a second cable drum 14' onto which is wound supporting cable 4 or 4' respectively. The rotation axes of cable drums 14, 14' are at least approximately parallel to the rotation axes of return pulleys 24, 24'. Each of the cable drums 14, 14' has a drive motor not shown in the drawings. The cable drums 14, 14' are particularly advantageous if it is necessary to use long lengths of supporting cables 4, 4' during working in considerable trench depths.

In addition, the soil working apparatus of the embodiment shown in FIGS. 6 to 10 differs from that embodiment described hereinbefore in that on the cutting frame 22 is provided a hydraulic feed cylinder 23 with which the two return pulleys 24, 24' for the supporting cables 4, 4' are vertically displaceable on the cutting frame 22. By operating said hydraulic feed cylinder 23 the vertical position of the return pulleys 24, 24' on cutter 20 can be modified and consequently the cutting depth of the cutting wheels 41, 41' can be varied, even in the case of fixed supporting cables 4, 4'.

For the displacement of the return pulleys 24, 24', on the hydraulic feed cylinder 23 is terminally provided a triangular-like support 63 on which the return pulleys 24, 24' are mounted. For protecting the hydraulic feed cylinder 23 the latter is surrounded by two telescopable sleeves 64, whereof one is fitted to the triangular-like support 63 and the other to the cutting frame 22.

Individual steps of a soil working method are illustrated in FIGS. 11 to 14. In the first method step illustrated in FIG. 11, the cutter 20 is introduced into a trench 80 located between two hardened trench wall primary panels 81, 81'. The actual trench 80 can be produced by the operation of the cutter 20 or by another trench wall mean. On introducing the cutter 20 into the trench 80, the holding frame 10 is left on the ground surface at the upper edge of trench 80. The supporting cables 4, 4' are in each case reeved in twin-lines on cutter 20 and one end of each is mounted at the holding frame 10, so that said holding frame 10 absorbs half the tensile force of cutter 20. In order not to overburden representation, the holding frame 10 is not shown in FIGS. 12 to 14.

On lowering the cutter 20 into the trench 80, the cutting wheels 41, 41' are in a retracted state. In said retracted state the cutting cross-section of the cutting wheels 41, 41' is inside the cross-section of trench 80 and cutting frame 22. Thus, on lowering the cutter 20 there is no removal of materials from the walls of the trench 80 through cutting wheels 41, 41'.

Figure 12:
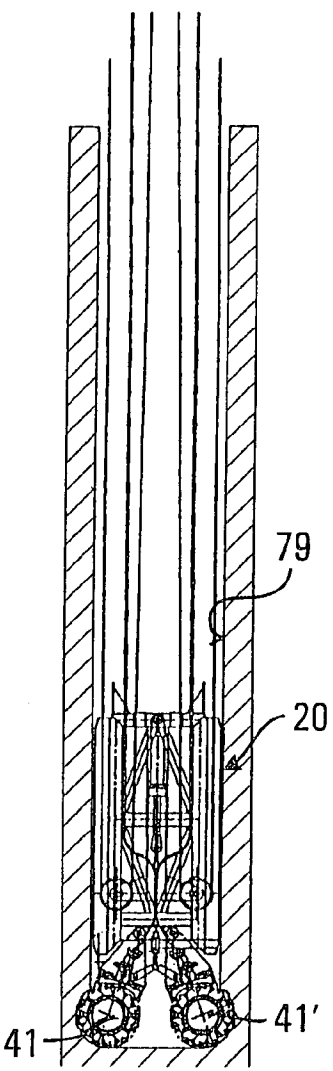

After the cutter 20 has been lowered onto the bottom of trench 80, the cutting wheels 41, 41' are rotated and through the operation of the adjusting device with the toggle lever mechanism are spread in opposition. As a result the cutting wheels 41, 41' enter into the two end walls 79 of trench 80. This state is shown in FIG. 12.

Figure 13:
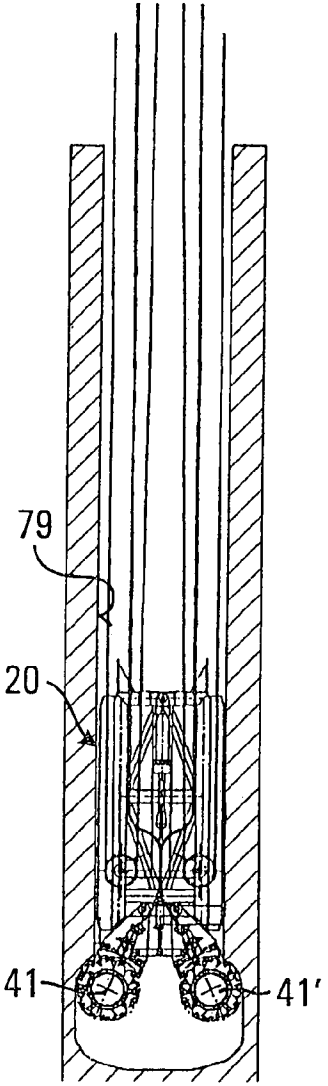

As is shown in FIG. 13, the cutter 20 is now raised and so the end walls 79 of trench 80 are cut from bottom to top. The comparatively high tensile forces of cutter 20 occurring on raising with spread cutting wheels 41, 41' are partly absorbed by the holding frame 10. In order to produce a particularly fluid-tight trench wall, the cutting wheels 41, 41' cut partially the primary panels 81, 81'.

The soil material produced during cutting drops by gravity below the cutter 20 onto the bottom of trench 80. It can be subsequently recovered from there using a grab. In this case the worked off soil material does not have to be sucked or pumped off. Thus, the cutter 20 is constructed without a pump mechanism for worked off soil material.

Figure 14:
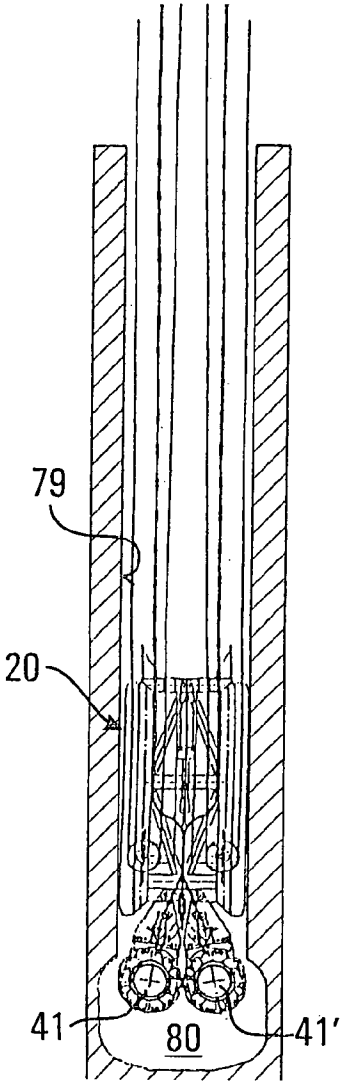

If an overcutting of the end walls of the trench 80 is required only over part of its total depth, in the manner shown in FIG. 14 the cutting wheels 41, 41' can be brought together again in slot 80 and the cutter 20 can then be raised without any action onto the walls of the trench 80.

Figure 15:
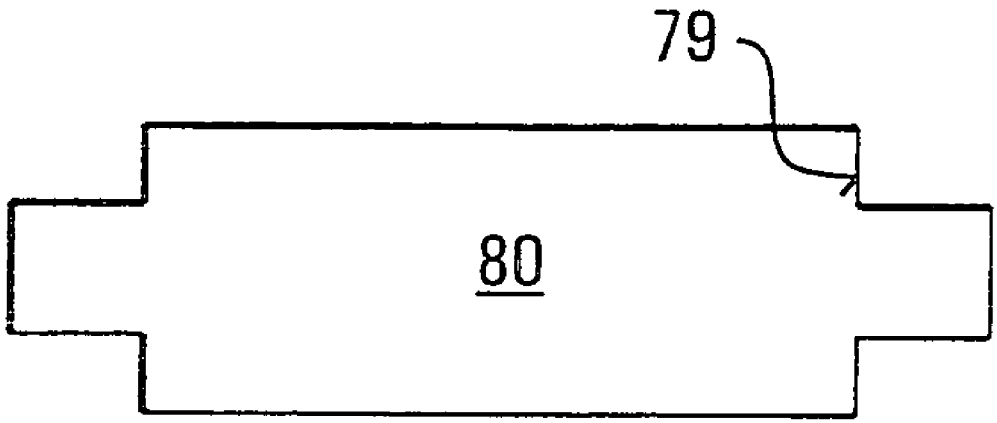
FIGS. 15 & 16 Cutting cross-sections of different soil working devices constructed as cutter.
Figure 16:
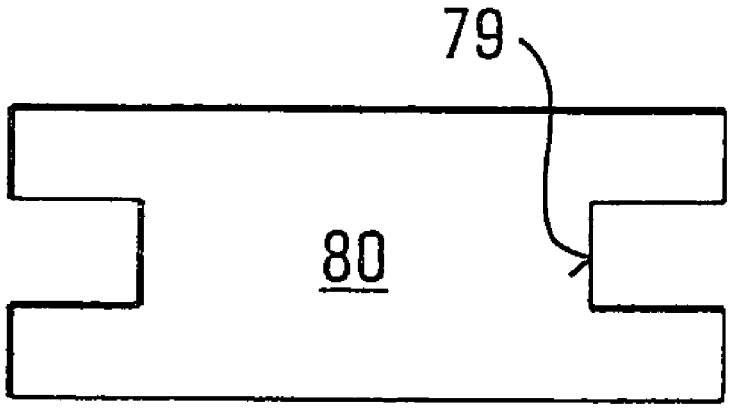

FIGS. 15 and 16 show different cutting cross-sections, which can be obtained in a soil working method. For producing particularly liquid-tight trench walls, it can in particular be provided that the end walls 74 of trench 80 are only cut over part of their total width and this is in particular profiled. For this purpose preferably cutting wheels 41, 41' are provided which have a width smaller than the width of the end walls 79.

The invention claimed is:

1. Apparatus for working the soil, comprising:

a supporting device, a soil working device for removing soil from a primary trench, at least one supporting cable reeved on the soil working device and connected to the supporting device for introducing the soil working device into the primary trench, at least one return pulley located on the soil working device, wherein the soil working device is hung in the at least one supporting cable via the at least one return pulley, holding means for suspending the soil working device, for introducing part of the tensile force of the soil working device into the primary trench at least during raising of the soil working device, and for subdividing with the supporting device the tensile force of the soil working device, while resting on a ground surface outside the primary trench, wherein the at least one supporting cable is terminally connected to the holding means, and supporting means for carrying the holding means and raising the holding means together therewith when the soil working device is raised from the ground and for leaving the holding means resting on the ground surface outside the primary trench when the soil working device is introduced into the primary trench.

2. Apparatus according to claim 1, wherein the holding means has at least one driven cable drum for winding up the at least one supporting cable.

3. Apparatus according to claim 1, wherein on the soil working device is provided driving means for driving the holding means on raising the soil working device out of the soil.

4. Apparatus according to claim 1, wherein the holding means has a passage opening for at least one of receiving and guiding the soil working device.

5. Apparatus according to claim 1, wherein the soil working device has at least two cutting wheels mounted in rotary manner, and adjusting means for adjusting the spacing of the rotation axes of both cutting wheels.

6. The apparatus of claim 5, wherein a plane of symmetry runs approximately parallel to the rotation axes of the cutting wheels.

7. Apparatus according to claim 1, wherein at least one of the soil working device and the holding means is constructed in mirror-symmetrical manner, at least with respect to the supporting cable guidance.

8. Apparatus according to claim 1, wherein the soil working device is constructed as a cutter for cutting away the side walls of the primary trench in the ground.

9. The apparatus of claim 1, wherein the soil working device is a cutter.

10. A method for working the soil using the apparatus for working the soil according to claim 1, comprising the steps of:

simultaneously placing the holding means on a ground surface outside the primary trench and lowering the soil working device from the supporting device and introducing the soil working device into the ground by means of the at least one supporting cable, simultaneously raising the holding means from the ground surface and raising the soil working device from the ground by means of the at least one supporting cable, introducing part of the cable tensile force into the ground via the holding means on at least one of lowering and raising of the soil working device, subdividing the tensile force of the soil working device over the supporting device and the holding means, and placing the holding means on a ground surface upon lowering the soil working device, and carrying the holding means with and raising the holding means together with the soil working device upon raising the soil working device from the ground, using the holding means.

11. The method according to claim 10, further comprising the step of terminally fixing the supporting cable in tension-proof manner to the holding means.

12. The method according to claim 10, further comprising the step of hanging the soil working device in the supporting cable by means of at least one return pulley located on the soil working device.

13. The method according to claim 10, further comprising the step of modifying a soil working cross-section of the soil working device in the ground.

14. The method according to claim 13, wherein the step of modifying a soil working cross-section is carried out prior to the step of raising of the soil working device.

15. The method according to claim 10, further comprising the steps of:

introducing the soil working device into a secondary trench, which is adjacent to at least one hardened primary panel formed in the primary trench, and partially cutting the at least one primary panel using the soil working device to partially cut the primary panel.

16. The method according to claim 15, wherein there are two hardened primary panels and the secondary trench is located between the two hardened primary panels, and wherein the step of introducing the soil working device into a secondary trench, the soil working device is introduced into the secondary trench between the two hardened primary panels.

17. The method according to claim 15, wherein the step of partially cutting comprises profiling the at least one primary panel.

18. Apparatus for working the soil, comprising:

a supporting device, a soil working device for removing soil from a primary trench, the soil working device having a frame portion and a cutting portion extending below the frame portion, and the soil working device having a raised state in which it is positioned above a the soil surface and a lowered state in which it is introduced into the primary trench, at least one cable suspending the soil working device from the supporting device for introducing the soil working device into the primary trench and raising it therefrom, the at least one cable being reeved on the soil working device, a holding frame having a passage therethrough for receiving the frame portion of the soil working device when the soil working device is in the raised state and for lowering the frame portion therefrom when the soil working device is moved to the lowered state, the holding frame having one end of the at least one cable terminally fixed thereto in tension-proof manner to enable the holding frame to absorb a portion of the tensile force of the soil working device when the soil working device is moved between the raised and lowered states and when the soil working device is in the lowered state, means for carrying the holding frame along with the frame portion of the soil working device when the soil working device is raised from the trench and for leaving the holding frame resting on the soil surface outside the primary trench when the soil working device is in the lowered state.

* * * * *